US008979254B2

(12) United States Patent
Ando et al.

(10) Patent No.: US 8,979,254 B2
(45) Date of Patent: Mar. 17, 2015

(54) LIQUID CIRCULATION DEVICE AND LIQUID EJECTION APPARATUS

(71) Applicant: Seiko Epson Corporation, Tokyo (JP)

(72) Inventors: Masaaki Ando, Nagano (JP); Kaoru Koike, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 13/845,559

(22) Filed: Mar. 18, 2013

(65) Prior Publication Data

US 2013/0271539 A1 Oct. 17, 2013

(30) Foreign Application Priority Data

Apr. 17, 2012 (JP) ..... 2012-093643

(51) Int. Cl.

| | |
|---|---|
| ***B41J 2/185*** | (2006.01) |
| ***B41J 2/175*** | (2006.01) |
| ***B41J 2/18*** | (2006.01) |
| ***B41J 2/19*** | (2006.01) |

(52) U.S. Cl.

CPC . *B41J 2/185* (2013.01); *B41J 2/175* (2013.01)
USPC ..... 347/90; 347/85; 347/89; 347/92

(58) Field of Classification Search

USPC ..... 347/17, 84, 85, 89, 90, 92
See application file for complete search history.

(56) References Cited

U.S. PATENT DOCUMENTS

| | | | |
|---|---|---|---|
| 7,815,277 | B2 | 10/2010 | Yamada |
| 2009/0179937 | A1 | 7/2009 | Yamada |
| 2011/0080456 | A1 | 4/2011 | Shibata et al. |

FOREIGN PATENT DOCUMENTS

| | | | |
|---|---|---|---|
| JP | 2009-101668 | A | 5/2009 |
| JP | 2009-166307 | A | 7/2009 |
| JP | 2011-079169 | A | 4/2011 |

*Primary Examiner* — Jannelle M Lebron
(74) *Attorney, Agent, or Firm* — Global IP Counselors, LLP

(57) ABSTRACT

A liquid circulation device includes a supply unit that forms a flow path supplying a liquid from a reservoir unit; a collection unit that forms a flow path collecting the liquid to the reservoir unit; and N number of the connection units provided respectively corresponding to N number of ejection units ejecting the liquid forming a flow path connecting the supply unit and the collection unit via the ejection units, wherein with regard to each of N number of the connection units, a connection order of the connection units with respect to the supply unit, which is counted from upstream in a flow direction of the liquid in the supply unit coincides with a connection order of the connection units with respect to the collection unit, which is counted from upstream in the flow direction of the liquid in the collection unit.

8 Claims, 2 Drawing Sheets

LIQUID CIRCULATION DEVICE AND LIQUID EJECTION APPARATUS

BACKGROUND

1. Technical Field

The present invention relates to a liquid circulation device and a liquid ejection apparatus which circulate a liquid via a plurality of ejection units.

2. Related Art

An ink circulation type printer has been known (refer to JP-A-2011-79169, JP-A-2009-166307 and JP-A-2009-101668), in which an ink is supplied from an ink tank, and is collected again into the ink tank via a plurality of ejection heads. In JP-A-2011-79169, JP-A-2009-166307 and JP-A-2009-101668, a common supply unit to which the ink is supplied from the ink tank and a collection unit collecting the ink to the ink tank are provided, and connection units connecting between the supply unit and the collection unit are provided corresponding to the plurality of ejection heads, respectively. The connection units, via each of plurality of ejection heads, can supply the ink to each of the plurality of ejection heads.

SUMMARY

However, there is a problem in that respective flow rates of the ink in the plurality of the connection units are different from each other. That is, there is a problem in that the respective flow rates of the ink supplied to the plurality of ejection heads are different from each other, and variations occur in ejection states of ink droplets in the plurality of ejection heads.

An advantage of some aspects of the invention is to provide a liquid circulation device which suppresses variations in a flow rate of a liquid supplied to a plurality of ejection units.

According to an aspect of the invention, there is provided a liquid circulating apparatus including a supply unit that forms a flow path supplying a liquid from the reservoir unit, and a collection unit that forms a flow path collecting the liquid to a reservoir unit. In addition, the liquid circulation device includes N number of the connection units provided respectively corresponding to N number (N means a natural number of three or more) of ejection units ejecting the liquid, and forming a flow path connecting the supply unit and the collection unit via the ejection units. Then, with regard to each of N number of the connection units, a connection order of the connection units with respect to the supply unit, which is counted from upstream in a flow direction of the liquid in the supply unit, coincides with a connection order of the connection units with respect to the collection unit, which is counted from upstream in the flow direction of the liquid in the collection unit. For example, the connection unit whose connection order with the supply unit is the first connection order will also be the first in the connection order with the collection unit, and the connection unit whose connection order with the supply unit is Nth order will also be the Nth order in the order with the collection unit.

In the above-described configuration, a liquid pressure suffers a loss as it goes downstream in the flow path. Accordingly, the lower the connection order of the connection unit, the smaller a pressure loss in the connection point with the supply unit, and the lower the connection order of the connection unit, the larger the liquid pressure at the connection point with the supply unit. Similarly, the lower the connection order of the connection unit, the smaller the pressure loss in the connection point with the collection unit, and the lower the connection order of the connection unit, the larger the liquid pressure at the connection point with the collection unit. That is, the larger the liquid pressure at the connection point with the supply unit, the larger the liquid pressure at the connection point with the collection unit. Accordingly, with regard to each of N numbers of the connection units, it is possible to suppress the variations in a pressure difference between the liquid pressure at the connection point with the supply unit and the liquid pressure at the connection point with the collection unit. For example, the connection unit whose connection order is the first connection order will have the largest liquid pressure at the connection point with the supply unit, but will also have the largest liquid pressure at the connection point with the collection unit. Therefore, a noticeable pressure difference between the connection points can be prevented compared to other connection units. Here, a liquid flow rate in the connection unit depends on the pressure difference between the pressure at the connection point with the supply unit and the pressure at the connection point with the collection unit. Accordingly, the variations in the pressure difference in N number of the connection units can be suppressed to suppress the variations in the liquid flow rate in N number of the connection units.

Furthermore, a flow path resistance of the flow path is identical configured to be the same even when passing via any one of N number of the connection units, whose start point is a connection point between the connection units having the first connection order and the supply unit, and whose end point is the connection point between the connection units having the Nth connection order and the collection unit. Thereby, even via any one of N number of the connection units, the flow path resistance may be identical to suppress the variations in the liquid flow rate in N number of the connection units each.

Furthermore, the supply unit and the collection unit mutually have an identical and a constant flow path cross-sectional area and N number of the connection units all have the identical flow path cross-sectional area. Furthermore, intervals between the connection points each with the connection units in the supply unit are all identical to intervals between the connection points each with the connection units in the collection unit may be all the same. By making the supply unit and the collection unit mutually have the identical and constant flow path cross-sectional area, the flow path resistance per unit length in the supply unit and the collection unit may be made constant. Furthermore, by making intervals between the connection points each with the connection units in the supply unit and intervals between the connection points each with the connection units in the collection unit all identical, a flow path resistance (hereinafter, denoted by $R_S$) between the connection points each in the supply unit and the collection unit may be made all identical. In addition, by making N number of the connection units have the identical flow path cross-sectional area, a flow path resistance (hereinafter, denoted by $R_C$) in all the connection units may be made identical.

Here, contemplation is made with regard to a flow path resistance (hereinafter, denoted by R) of the entire flow path, whose the start point is the connection point between the connection unit having the first connection order and the supply unit, via the connection unit having the Mth connection order (M is a natural number equal to or less than N), and whose end point is the connection point between the connection unit having the Nth connection order and the collection unit. The flow path resistance from the connection point (start point) between the connection unit having the first connection order and the supply unit to the connection point between the connection unit having the Mth connection order and the supply unit may be expressed as below:

$$R_S \times (M-1)$$

In addition, the flow path resistance from the connection point between the connection unit having the Mth connection order and the collection unit to the connection point (end point) between the connection unit having the Nth connection order and the collection unit may be expressed as below:

$$R_S \times (N-M)$$

Accordingly, the flow path resistance of the entire flow path from the start point to the end point may be expressed as below:

$$R = R_S \times (M-1) + R_C + R_S \times (N-M), \text{ that is,}$$

$$R = R_S \times (N-1) + R_C$$

That is, the flow path resistance R of the entire flow path whose start point is the connection point between the connection unit having the first connection order and the supply unit, via the connection unit having the Mth connection order, and whose end point is the connection point between the connection unit having the Nth connection order and the collection unit may not depend on the connection order (M) via the connection units. Accordingly, even via any one of N number of the connection units, the flow path resistance R may be made identical to suppress the variations in the liquid flow rate in N number of the connection units, respectively.

Furthermore, the connection units may be arranged in the connecting order, and a supply port supplying the liquid to the supply unit and a collection port collecting the liquid from the collection unit may be configured to be located at the connection unit side whose connecting order is the Nth in the arrangement direction of the connection units. Thereby, a liquid inlet/outlet port may be provided at one side in the arrangement direction of the connection units. Accordingly, the reservoir unit may be connected to one side in the arrangement direction of the connection units so as to miniaturize the liquid circulation device. In this case, in the supply unit, the connection point with the connection unit having the first connection order and the supply port are located at the opposite side to each other in the arrangement direction of the connection units. Therefore, by providing a non-branch unit which has the supply port as the start point, and has the connection point with the connection unit having the first connection order as the end point, the liquid may be supplied from the supply port to the connection point of the connection unit having the first connection order. In addition, since the liquid pressure may be caused to lose in the non-branch unit connecting from one side to the opposite side in the arrangement direction of the connection units, the liquid pressure may be suppressed in the ejection unit. Thus, the liquid may be prevented from being unexpectedly ejected from the ejection unit.

In addition, the supply unit may be provided at a bottom surface of a plate-like member, and the collection unit may be provided at a top surface of the plate-like member. By using both surfaces of the plate-like member, the supply unit and the collection unit can be formed thereon, and therefore, the production cost can be saved. In addition, by providing the collection unit at the top surface of the plate-like member, the collection unit can be located at a higher position and thereby bubbles reaching the collection unit can be prevented from returning to the ejection unit.

The liquid circulation device including the supply unit, the connection unit and the collection unit according to the invention may be incorporated into a liquid ejection apparatus including ejection units ejecting the liquid. It is obvious that the liquid ejection apparatus has the same effects as in the invention. Furthermore, even in the liquid circulation method of circulating the liquid using the fluid circulation apparatus of the invention, the effect of the present invention may be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Here, an embodiment of the invention will be described according to the following order:

1. Printer Configuration:
2. Modification Example:

1. Printer Configuration

Figure 1:
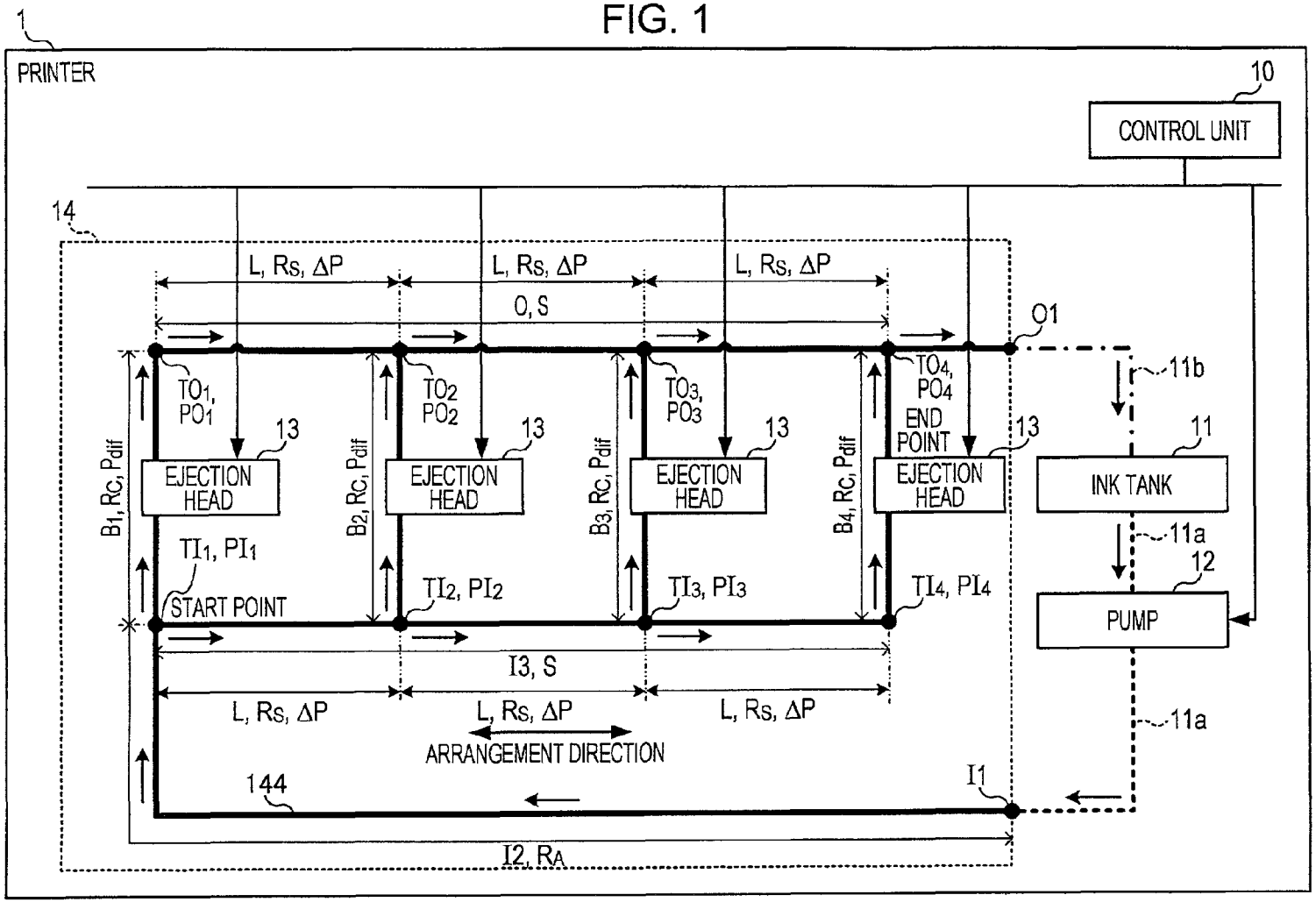
FIG. 1 is a block diagram of a printer.

FIG. 1 is a block diagram illustrating a printer 1 as the liquid ejection apparatus including the liquid circulation device according to one embodiment of the invention. The printer 1 includes a control unit 10, an ink tank 11, a pump 12, an ejection head 13 and an ink circulation flow path 144 (illustrated by a thick line). The control unit 10 controls the pump 12 and the ejection head 13. The ink tank 11 is a reservoir unit that stores the ink as the liquid to be ejected from the ejection head 13. The pump 12 generates a pressure to flow the ink in the ink circulation flow path 144. The ejection head 13 includes an ink chamber communicating with a plurality of nozzles respectively and is an ejection unit ejecting the ink from the nozzles by driving drive elements to change the pressure inside the ink chamber.

In the present embodiment, the four number (=N) of the ejection heads 13 are provided. In addition, in a case where the printer 1 ejects a plurality of types of ink, the printer 1 includes the ink tank 11, the pump 12, and the ink circulation unit 14 (illustrated by a dotted line) for each ink type, and N number of the ejecting head 13 is respectively provided for each type of the ink. In the embodiment, to simplify the description, the ink circulation unit 14 which is provided for one type of the ink will be described. The ink circulation unit 14 forms a flow path circulating the ink between the ink tank 11 and the ejection heads 13.

The inner wall surface formed with the flow path in the ink circulation flow path 144 has a uniform friction resistance. The ink circulation flow path 144 includes a supply unit I, a connection unit B and a collection unit O. The supply unit I is connected with an inlet tube 11*a* (illustrated by a thick dashed line) in a supply port I1. An inlet tube 11*a* is connected with the supply port I1 and the ink tank 11 via the pump 12. Accordingly, driving the pump 12 causes the ink in the ink tank 11 to be supplied to the supply unit I via the inlet tube 11*a*.

The supply unit I includes a non-branch unit I2 and a branch unit I3. The non-branch unit I2 forms a flow path which is neither diverged nor converged. In addition, the non-branch unit I2 forms a flow path in the arrangement direction by arranging the four ejection heads 13 in a row, in which the supply port I1 side in the arrangement direction is a start point and the opposite side of the supply port I1 side in the arrangement direction is an end point. The branch unit I3 starts from the end point of the non-branch unit I2. The branch unit I3 forms a flow path in the arrangement direction of the four ejection heads 13 and by the four connection units $B_M$ are connected to the branch unit I3 so as to be diverged.

The connection units $B_M$ are provided corresponding to each of the four ejection heads 13, the respective connection units $B_M$ form a flow path which connects the supply unit I (branch unit I3) and the collection unit O via the ejection heads 13. In addition, the subscript M (natural number equal to or less than N) in the connection units $B_M$ means the connection order of the four connection units B to be connected with the branch unit I3. In addition, the connection order is counted in the order from upstream in the flow direction of the ink in the branch unit I3. Furthermore, locations of connecting the connection units $B_M$ with respect to the branch unit I3 are indicated by connection points $TI_M$.

In a connection point $TI_1$ to which a connection unit $B_1$ having the first connection order with respect to the supply unit I is connected, the non-branch unit I2 ends the end point and the branch unit I3 starts. In addition, the branch unit I3 ends at a connection point $TI_4$ to which a connection unit $B_4$ having the fourth connection order with respect to the supply unit I is connected. The interval between the nearest connection points $TI_M$ each has a constant length L. In addition, the flow path cross-sectional area of the branch units 13 has a constant area S. In addition, the four connection units $B_M$ all have the same shapes, and also the flow path cross-sectional areas are all the same.

The collection unit O forms a flow path in the arrangement direction of the four ejection heads 13. The collection unit O is opened at a collection port O1. The collection port O1 is formed at the supply port I1 side in the arrangement direction of the four ejection heads 13. The collection unit O is connected to an outlet tube 11*b* in the collection port O1. By driving the pump 12, the ink is collected from the collection unit O to the ink tank 11 via the outlet tube 11*b*. The flow direction of the ink in the collection unit O is a direction toward the collection port O1 and is the same as the flow direction of the ink in the branch unit I3 of the supply unit I.

The four connection units $B_M$ are connected to the collection unit O so as to converge the connection order of the connection units $B_M$ with respect to the collection unit O, which is counted from upstream in the flow direction of the ink, coincides with the connection order of the connection units $B_M$ with respect to the supply unit I. Therefore, the connection order of the connection units $B_M$ with respect to the collection unit O is also indicated by M. In addition, locations to which the connection units $B_M$ are connected with respect to the collection unit O are indicated by connection points $TO_M$. In the collection unit O, a connection point $TO_1$ to which the connection unit $B_1$ having the first connection order is connected is the start point. In the collection unit O, the interval between the nearest connection points $TO_M$ each also has the constant length L. In addition, the flow path cross-sectional area of the collection unit O also has the constant area S in the same way as the branch unit I3.

The flow path resistance in the above-described ink circulation flow path 144 will be contemplated.

First, a predetermined flow path resistance $R_A$ is present in the non-branch unit I2 to which the ink is supplied from the supply port I1. The branch unit I3 has the constant flow path cross-sectional area S, and therefore the flow path resistance per unit length in the flow direction is constant. In addition, the interval between the nearest connection points $TI_M$ has the constant length L, and therefore the flow resistances between the nearest connection points $TI_M$ each are all the same. Herein, the flow path resistance between the nearest connection points $TI_M$ in the branch unit I3 is indicated by $R_S$. In addition, the four connection units $B_M$ have all the same shape, and therefore flow path resistances $R_C$ in the connection units $B_M$ are all the same. In addition, the collection unit O has the constant flow path cross-sectional area S, and therefore, the flow path resistance per unit length in the flow direction is constant. In addition, the interval between the nearest connection points $TO_M$ has the constant length L, and therefore the flow resistances between the nearest connection points $TO_M$ each are all the same. Since the flow path cross-sectional areas S in the branch unit I3 and the collection unit O are the same as each other, the flow path resistances between the nearest connection points $TO_M$ in the collection unit O are the same as the flow path resistances $R_S$ between the nearest connection points $TI_M$ each in the branch unit I3.

Here, it is contemplated with regard to the flow path resistance R of the entire flow path, whose start point is the connection point $TI_1$ between the connection unit $B_1$ having the first connection order and the branch unit I3, and whose end point is the connection point $TO_N$ between the connection unit $B_N$ having the Nth connection order and the collection unit O. The flow path resistance from the connection point $TI_1$ (start point) between the connection unit $B_1$ having the first connection order and the branch unit I3 to the connection point $TI_M$ between the connection point $B_M$ having the Mth connection order and the branch unit 13 can be expressed as below:

$$R_S\times(M-1)$$

In addition, the flow path resistance from the connection point $TO_M$ between the connection unit $B_M$ having Mth connection order and the collection unit O to the connection point $TO_N$ (end point) between the connection unit $B_N$ having Nth connection order and the collection unit O can be expressed as below:

$$R_S\times(N-M)$$

Accordingly, the flow path resistance of the entire flow path from the start point $TI_1$ to the end point $TO_N$ can be expressed as below:

$$R=R_S\times(M-1)+R_C+R_S\times(N-M), \text{ that is,}$$

$$R=R_S\times(N-1)+R_C$$

That is, the flow path resistance R of the entire flow path, whose start point is the connection point $TI_1$ between the connection unit $B_1$ having the first connection order and the branch unit I3, via the connection unit $B_M$ having the Mth connection order, and whose end point is the connection point $TO_N$ between the connection unit $B_N$ having Nth connection order and the collection unit O may not depend on the connection order (M) via the connection units $B_M$. Accordingly, even via any one of N number of the connection units $B_M$, it is possible to make the flow path resistance R identical and to suppress the variations in the liquid flow rate in respective N number of the connection units $B_M$.

In the present embodiment, because of N=4, the flow path resistance R of the entire flow path from the start point $TI_1$ to the end point $TO_N$ can be expressed as below:

$$R=3\times R_S+R_C$$

Even via any one of the four connection units $B_M$, the three of the flow path between the nearest connection points $TI_M$ each in the branch unit I3 and three portions of the flow path between the nearest connection points $TO_M$ each in the collection unit O are be passed through. Accordingly, the flow path resistance R of the entire flow path from the start point $TI_1$ to the end point $TO_4$ is expressed by a sum of three times the flow path resistance $R_S$ between the nearest connection points $TI_M$ each or the connection points $TO_M$ each, and the flow path resistance $R_C$ in the connection points $B_M$.

Here, the pressure generated by the pump 12 loses as it goes in the downstream according to the flow path resistance in the ink circulation flow path 144. Accordingly, the pressure in the branch unit I3 increase as it goes the connection point $TI_M$ to which the connection unit $B_M$ having the faster connection order is connected. In addition, the flow path resistance $R_S$ between the nearest connection units $B_M$ each in the branch unit I3 is all the same, and therefore a loss amount ΔP in the pressure lost between the nearest connection units $B_M$ each is also the same. Similarly, the pressure in the collection unit O increases as it goes the connection point $TO_M$ to which the connection unit $B_M$ having the faster connection order is connected. In addition, the loss amount ΔP in the pressure lost between the nearest connection units $B_M$ each in the collection unit O is also the same. Of course, the flow path resistances $R_S$ of the branch unit I3 and the collection unit O are the same as each other and therefore, the loss amount ΔP in the branch unit I3 and the collection unit O is consistent.

Here, the pressure in the start point of the branch unit I3 is assumed to be $PI_1$ and the pressure in the start point of the collection unit O is assumed to be $PO_1$. Then, if the pressure in the connection point $TI_M$ between the connection unit $B_M$ having the Mth connection order and the branch unit I3 is assumed to be $PI_M$, it can be expressed as below:

$$PI_M = PI_1 - \Delta P(M-1)$$

In addition, if the pressure in the connection point $TO_M$ between the connection unit $B_M$ having the Mth connection order and the collection unit O is assumed to be $PO_M$, it can be expressed as below:

$$PO_M = PO_1 - \Delta P(M-1)$$

Accordingly, the pressure difference $P_{dif}$ between the pressure $PI_M$ in the connection point $TI_M$ between the connection unit $B_M$ and the branch unit I3, and the pressure $PO_M$ in the connection point $TO_M$ between the connection unit $B_M$ and the collection unit O can be expressed as below:

$$P_{dif} = PI_M - PO_M = PI_1 - PO_1$$

That is, the pressure difference $P_{dif}$ in both ends of the connection unit $B_M$ may not depend on the connection order (M) in the connection units $B_M$. Accordingly, the pressure difference $P_{dif}$ in any one of N number of the connection units $B_M$ may be made identical, and thus the variations in the liquid flow rate in the respect N number of the connection units $B_M$ may be suppressed.

In addition, the pressure $PI_1$ in the start point of the branch unit I3 becomes a pressure lost as much as it corresponds to the $R_A$ in the non-branch unit I2. Accordingly, it is possible to suppress the pressure $PI_M$ in the connection point $TI_M$ between the connection unit $B_M$ and the branch unit I3, and also to suppress the ink pressure in the ejection head 13. By suppressing the ink pressure in the ejection head 13, for example, the pressure acting on the ink near the nozzle of the ejection head 13 may be suppressed. Therefore, the ink droplets may be prevented from being unexpectedly ejected from the nozzle during non-actuation of the drive element.

Figure 2A:
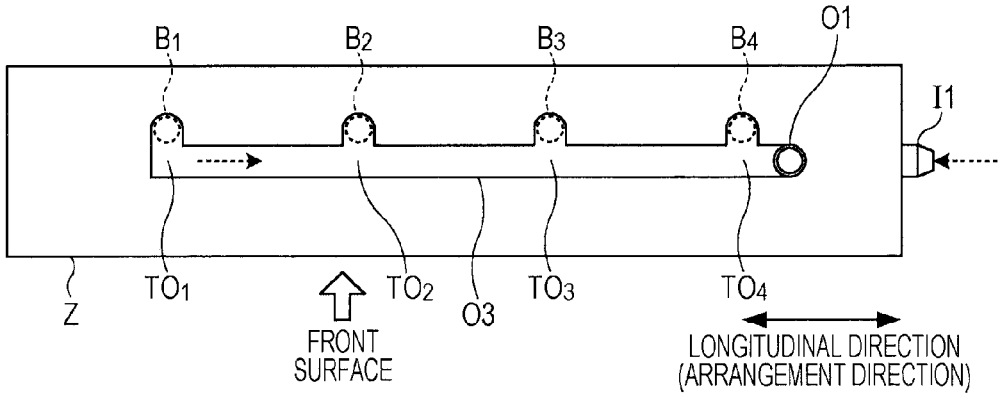
FIG. 2A is a plan view of an ink circulation unit.
Figure 2B:
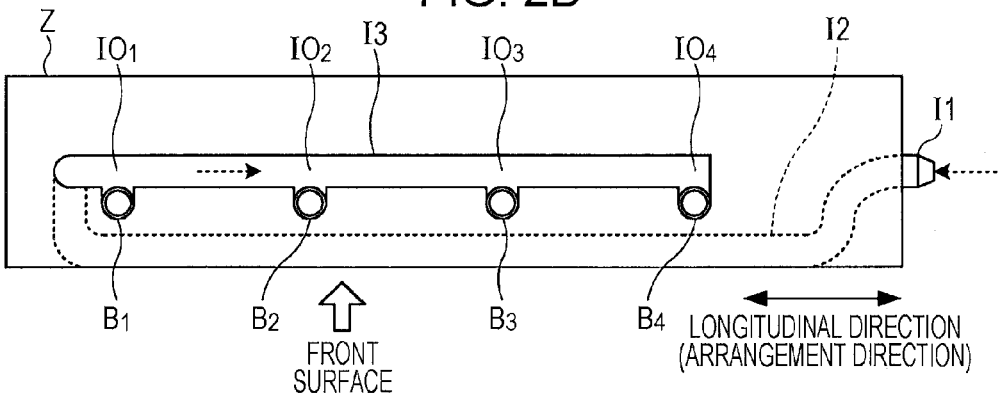
FIG. 2B is a bottom view of the ink circulation unit.
Figure 2C:
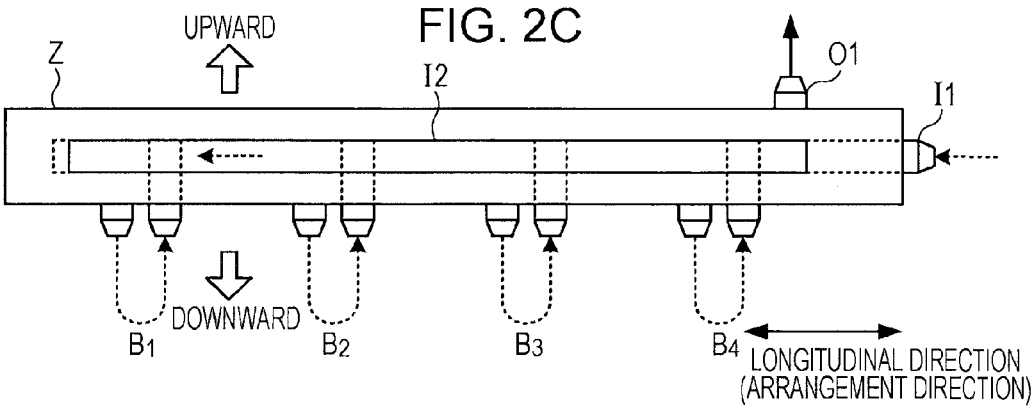
FIG. 2C is a front view of the ink circulation unit.

FIG. 2A is a plan view of the ink circulation unit 14, FIG. 2B is a bottom view of the ink circulation unit 14, and FIG. 2C is a front view of the ink circulation unit 14. In the ink circulation unit 14, the supply unit I (non-branch unit I2, branch unit I3), the connection unit $B_M$ and the collection unit O are prepared by forming grooves and holes for a flat plate-like member Z. For example, the grooves and holes can be formed corresponding to the supply unit I, the connection unit $B_M$ and the collection unit O using a router or drill. As illustrated in FIG. 2A, the collection unit O is prepared by forming linear grooves on the top surface of the plate-like member Z. In addition, a flat surface-like film (not illustrated) is laminated on the top surface of the plate-like member Z where the grooves are formed, and thereby the grooves are covered so that the collection unit O can be formed. As illustrated in FIG. 2B, the branch unit I3 is prepared by forming the grooves on the bottom surface of the plate-like member Z. In addition, a flat surface-like film (not illustrated) is laminated on the bottom surface of the plate-like member Z where grooves are formed, and thereby the grooves are covered so that the branch unit I3 can be formed. Furthermore, as illustrated in FIG. 2C, the non-branch unit I2 is prepared by forming the grooves on the front surface of the plate-like member Z. In addition, a flat surface-like film (not illustrated) is laminated on the front surface of the plate-like member Z where grooves are formed, and thereby the grooves are covered so that the collection unit O can be formed. In addition, a depth and a width of the groove corresponding to the non-branch unit I2 are constant, and the depth and the width of the groove corresponding to the collection unit O are also constant. Furthermore, the depth and the width of the groove corresponding to the non-branch unit I2 are equal to the depth and the width of the groove corresponding to the collecting unit O.

The supply port I1 of the supply unit I and the collection port O1 of the collection unit O are disposed at the right side of the sheet surface in the longitudinal direction of the plate-like member Z. In addition, the longitudinal direction of the plate-like member Z coincides with the arrangement direction of the four ejection heads 13. As illustrated in FIG. 2B, the non-branch unit I2 starting from the collection port O1 is connected to the branch unit I3 at the connection point $IO_1$ at the left side of the sheet, and the ink supplied from the supply port I1 flows to the left side of the sheet surface at the non-branch unit I2 so as to reach the branch unit I3. The ink in the branch unit I3 flows in the right side of the sheet surface so as to be diverged to the connection units $B_1$ to $B_4$ sequentially at the connection points $TI_1$ to $TI_4$. In addition, the ink flows to the right side of the sheet surface even in the collection unit O, and converges on the connection points $B_1$ to $B_4$ sequentially at the connection points $TO_1$ to $TO_4$. As illustrated in FIG. 2C, the connection units $B_1$ to $B_4$ in the connection points $TI_1$ to $TI_4$ and $TO_1$ to $TO_4$ are connected from below so as to provide four ejection heads 13 at the bottom of the plate-like member Z.

With a configuration as described above, since the branch unit I3 of the supply unit I and the collection unit O may be formed using both the upper and lower sides of the plate-like member Z, the production cost may be saved. Furthermore, since the non-branch unit I2 of the supply unit I may be formed using the front surface of the plate-like member Z, the production cost may be saved. In addition, providing the collection unit O at the upper surface of the plate-like member Z enables the collection unit O to be positioned high in the vertical direction, whereby preventing bubbles reaching the collection unit O from returning to the head 13.

2. Modification Example

In the above-described embodiment, the supply port I1 of the supply unit I and the collection port O1 of the collection unit O are disposed at one side in the arrangement direction of the connection units $B_1$ to $B_4$, but the supply port I1 of the supply unit I and the collection port O1 of the collection unit O may be disposed at the other side of the arrangement direction of the connection units $B_1$ to $B_4$. That is, in FIGS. 2A to 2C, the non-branch unit I may be omitted, and the supply port I1 may be formed at the left side of the sheet surface so as to directly supply the ink from the supply port I1 to the branch unit I3.

In addition, the ink circulation flow path 144 may not be necessarily formed in the plate-like member Z. That is, the connection order of the connection units $B_M$ in the supply unit I and the collection unit O may coincide with each other, and for example, the ink circulation flow path 144 may be formed by connecting tubes having a constant inner diameter. In the above-described embodiment, an example of ejecting the ink using the printer 1 has been described, but the printer 1 may eject other liquid except for the ink. Furthermore, in the ejection head 13, the liquid may be ejected by the application of the pressure using a mechanical change in piezoelectric elements, or by the application of the pressure using generated bubbles.

The entire disclosure of Japanese Patent Application No. 2012-093643, filed Apr. 17, 2012 is expressly incorporated by reference herein.

What is claimed is:

1. A liquid circulation device, comprising:

a supply unit that forms a supply flow path supplying a liquid from a reservoir unit in a supply direction;

a collection unit that forms a collection flow path collecting the liquid to the reservoir unit in a collection direction; and N number of connection units provided respectively corresponding to N number (N means a natural number of three or more) of ejection units ejecting the liquid, the connection units forming a connection flow path connecting the supply unit and the collection unit via the ejection units, each of the connection units having a supply connection point and a collection connection point, the supply connection point being a point at which each of the connection units connects the supply unit, the collection connection point being a point at which each of the connection units connects the collection unit, the connection units being arranged parallel relative to each other with respect to the supply unit and the collection unit such that the supply connection points are arranged along the supply unit from upstream to downstream of the supply direction and such that the collection connection points corresponding to the supply connection points, respectively, are arranged along the collection unit from upstream to downstream of the collection direction, with regard to each of the N number of the connection units, a connection order of the connection units with respect to the supply unit, which is counted from upstream in a flow direction of the liquid in the supply unit coinciding with a connection order of the connection units with respect to the collection unit, which is counted from upstream in the flow direction of the liquid in the collection unit.

2. The liquid circulation device according to claim 1, wherein the connection units are disposed in the connection order, wherein a supply port supplying the liquid to the supply unit and a collection port collecting the liquid from the collection unit are located at the connection unit side whose connection order is the Nth in an arrangement direction of the connection units, and wherein the supply unit includes a non-branch unit whose start point is the supply port and whose end point is the supply connection point with the connection unit whose connection order is the first.

3. The liquid circulation device according to claim 1, wherein the supply unit is provided at a bottom surface of a plate-like member and the collection unit is provided at a top surface of the plate-like member.

4. The liquid circulation device according to claim 1, further comprising a single plate-like member, the supply unit being disposed on a first surface side of the single plate-like member, the collection unit being disposed on a second surface side of the single plate-like member, the first surface side and the second surface side being opposite each other.

5. The liquid circulation device according to claim 1, further comprising a supply port disposed at an upstream end of the supply unit in the supply direction and configured to supply the liquid into the supply unit, and a collection port disposed at a downstream end of the collection unit in the collection direction and configured to discharge the liquid from the collection unit to outside of the liquid circulation device, a first direction in which the supply port supplies the liquid into the supply unit intersecting a second direction in which the collection port discharges the liquid from the collection unit to the outside.

6. The liquid circulation device according to claim 1, wherein a flow path resistance of a flow path whose a start point is a supply connection point having the first connection order and whose end point is the collection connection point having Nth connection order is identical even via any one of the connection units.

7. The liquid circulation device according to claim 6, wherein the supply unit and the collection unit mutually have an identical and constant flow path cross-sectional area, and the connection units all have the identical flow path cross-sectional area, and wherein intervals between the supply connection points in the supply unit are all identical to intervals between the collection connection points in the collection unit.

8. A liquid ejection apparatus comprising:

a supply unit that forms a supply flow path supplying a liquid from a reservoir unit in a supply direction;

a collection unit that forms a collection flow path collecting the liquid to the reservoir unit in a collection direction;

N number (N means a natural number of three or more) of ejection units ejecting the liquid; and N number of connection units provided respectively corresponding to N number of the ejection units ejecting the liquid, the connection units forming a connection flow path connecting the supply unit and the collection unit via the ejection units, each of the connection units having a supply connection point and a collection connection point, the supply connection point being a point at which each of the connection units connects the supply unit, the collection connection point being a point at which each of the connection units connects the collection unit, the connection units being arranged parallel relative to each other with respect to the supply unit and the collection unit such that the supply connection points are arranged along the supply unit from upstream to downstream of the supply direction and such that the collection connection points corresponding to the supply connection points, respectively, are arranged along the collection unit from upstream to downstream of the collection direction, with regard to the N number of the connection units, a connection order of the connection units with respect to the supply unit which is counted from upstream in a flow direction of the liquid in the supply unit coinciding with a connection order of the connection units with respect to the collection unit which is counted from upstream in the flow direction of the liquid in the collection unit.

* * * * *